United States Patent [19]

Mikhail

[11] Patent Number: 4,878,432

[45] Date of Patent: Nov. 7, 1989

[54] MULTISTAGE KINETIC ENERGY PENETRATOR

[75] Inventor: Ameer G. Mikhail, Bel Air, Md.

[73] Assignee: The United States of America as represented by the Secretary of the Army, Washington, D.C.

[21] Appl. No.: 238,960

[22] Filed: Aug. 29, 1988

[51] Int. Cl.[4] ..... F42B 1/02

[52] U.S. Cl. ..... 102/309; 102/310; 102/476

[58] Field of Search ..... 102/308, 310, 476, 309, 102/489

[56] References Cited

U.S. PATENT DOCUMENTS

| | | | |
|---|---|---|---|
| 3,177,808 | 4/1965 | Owen | 102/307 |
| 3,916,794 | 11/1975 | Mayer | 102/306 |
| 4,036,140 | 7/1977 | Korr et al. | 102/38 |
| 4,374,495 | 2/1983 | Thomanek | 102/476 |
| 4,463,678 | 8/1984 | Weimer et al. | 102/307 |
| 4,488,489 | 12/1984 | Schoffl | 102/489 |

*Primary Examiner*—Peter A. Nelson

*Attorney, Agent, or Firm*—Saul Elbaum

[57] ABSTRACT

A hypervelocity kinetic energy projectile has multiple penetrator stages longitudinally stacked one onto the other which separate and fly independently of one another during the projectile's flight. Connecting rods passing through and interconnecting each penetrator stage have notches positioned and sized so that aerodynamic forces acting upon flare tails of the penetrator stages will sever the connecting rods in such a way that causes the penetrator stages to separate from one another in a rearward to forward sequence. Alternatively, time delay fuzes, small explosive charges or other electrical and mechanical systems may be used to control the penetrator stage separation.

8 Claims, 2 Drawing Sheets

MULTISTAGE KINETIC ENERGY PENETRATOR

RIGHTS OF THE GOVERNMENT

The invention described herein may be manufactured, used and licensed by or for the U.S. Government for Governmental purposes without payment to me of any royalty thereon.

BACKGROUND OF THE INVENTION

1. Field of the Invention

The present invention relates to hypervelocity kinetic energy penetrators and, more particularly, is directed towards a novel kinetic energy penetrator that will separate in flight into "n" stages of independent penetrators which follow each other by predetermined distances or time until target impact.

2. Description of the Prior Art

Kinetic energy projectiles are vehicles which are launched from large caliber gun tubes at very high velocities and aimed at various targets. For effective lethality, the velocities of these kinetic energy projectiles range from several to tens of times the speed of sound. The mass of these projectiles, along with the speed, determine the kinetic energy that will be transferred to the target on impact. This kinetic energy, E, is represented by (mass * velocity$^2$). The objective of these projectiles is to penetrate armor and other targets with the most lethality.

Terminal ballistics science has established that greater armor penetration depths can be achieved from a kinetic energy weapon if the same kinetic energy, E, impacting an armored target is split into smaller energy pulses, each of E/n value, impacting the same point on the target in succession of millisecond intervals. Consequently, it can be appreciated that a kinetic energy projectile that takes advantage of this terminal ballistic characteristic will be a substantial improvement over conventional kinetic energy projectiles.

SUMMARY OF THE INVENTION

It is therefore an object of the invention to provide a hypervelocity kinetic energy projectile with enhanced penetrating capabilities by taking advantage of terminal ballistic behavior.

It is a further object of the invention to provide a hypervelocity kinetic energy projectile that has multiple stages that maximizes penetration depth for the same kinetic energy as previous single stage kinetic energy projectiles.

It is still a further object of the invention to provide a hypervelocity kinetic energy projectile that has multiple stages that follow one another in succession to target impact.

It is still a further object of the invention to provide a hypervelocity, multistage, kinetic energy projectile that can be launched in one piece but then separate in flight in which each stage follows behind each other during flight, and then hits the same point on a target in succession within millisecond intervals.

In accordance with the invention, a kinetic energy projectile with enhanced penetrating capabilities works on the principle of having multiple stages or penetrators longitudinally stacked one onto the other. Means are provided for separating the independent penetrators in a predescribed rearward to forward sequence during projectile flight so that the penetrators fly independently and in spaced relation to one another before target impact.

The foregoing and other objects and advantages of the invention will appear from the following description. In the description reference is made to the accompanying drawings which form a part hereof, and in which there is shown by way of illustration and not of limitation a preferred embodiment. Such description does not represent the full extent of the invention, but rather the invention may be employed in different arrangements according to the breadth of the invention.

DESCRIPTION OF THE PREFERRED EMBODIMENTS

Figure 1:
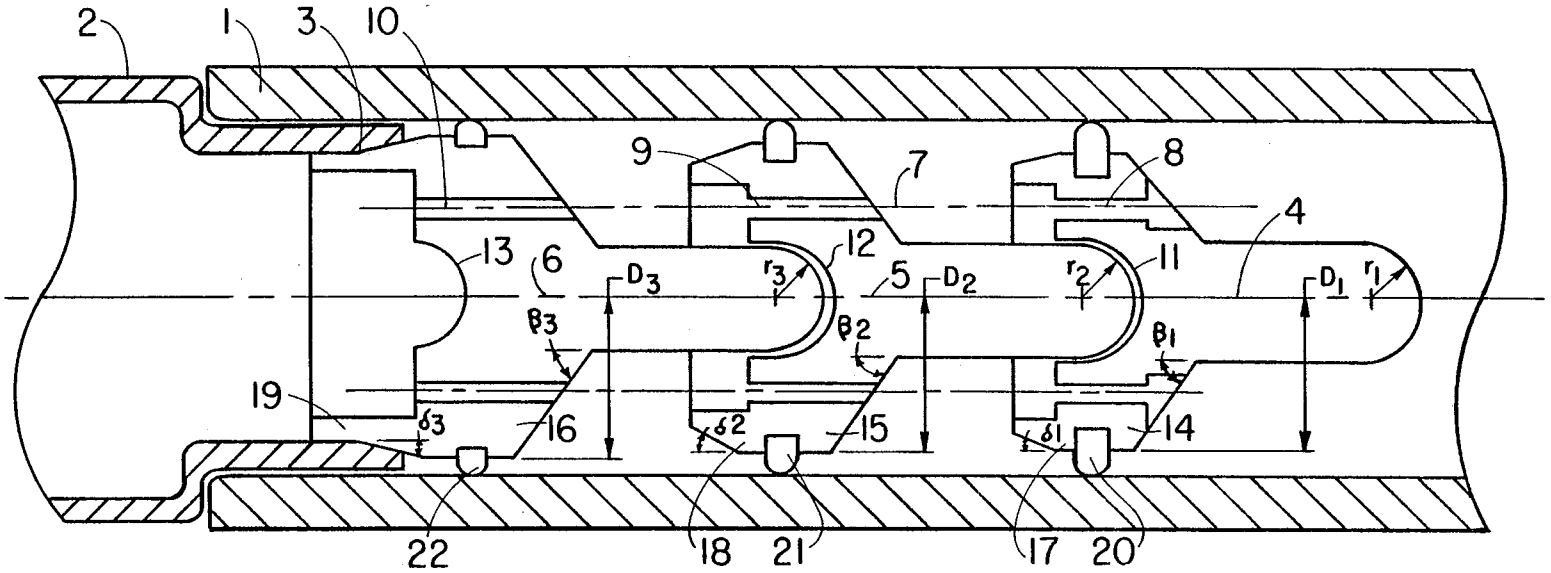
FIG. 1 shows a longitudinal sectional view of a multistage kinetic energy penetrator in a gun tube according to an aspect of the invention.

Referring now to the drawings, like reference numerals represent identical or corresponding parts throughout the several views.

Figure 2:
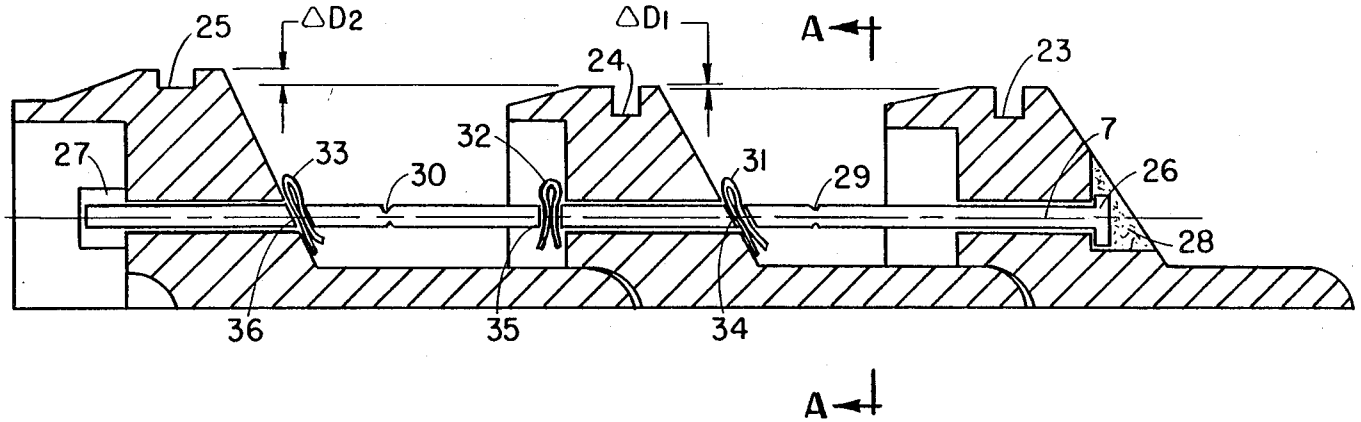
FIG. 2 shows a one half sectional view of a stacking arrangement of a multistage kinetic energy penetrator according to an aspect of the invention.
Figure 3:
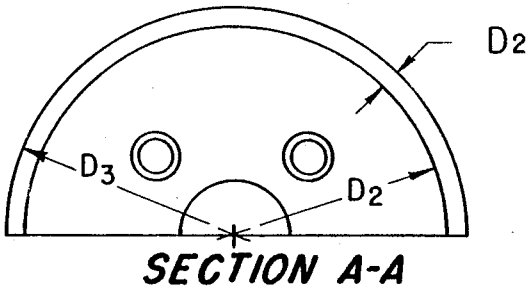
FIG. 3 shows a sectional view taken substantially as indicated along line A—A of the one half sectional view of FIG. 2.

FIG. 1 shows an example of an embodiment of a multistage kinetic energy projectile loaded in a gun tube 1. A primer case 2 holds a propellant charge, not shown, and three longitudinally stacked penetrator stages 4, 5, and 6. The leading or forward penetrator stage is designated as 4 while the intermediate and trailing or rearward penetrator stages are designated as 5 and 6 respectively. The penetrators are tightly secured to the primer case 2 through surface 3 of stage 6. Three penetrator stages are shown merely by way of example and is in no way meant to limit the number of stages that could be employed in the invention. The three penetrator stages 4, 5, and 6 are interconnected through four, or any other necessary number, of rods in which one rod 7 is shown in FIG. 2. The rod 7 passes through axial bores 8, 9 and 10 in the penetrator stages 4, 5 and 6 respectively and is used to hold the penetrator stages together until separation. The penetrator stages 4, 5 and 6 are shown with blunt substantially hemispherical noses of radii $r_1$, $r_2$, and $r_3$. However, this nose configuration is not mandatory and other nose shapes with low air resistance and high surface contact area may be used. The three penetrator stages have base cavities 11, 12, and 13 shaped to accept the nose of each preceding penetrator stage for providing uniform contact for pushing. While other shapes may be used the substantially hemispherical nose provides large contact surface and reduces effects on non-alignment. Obviously, this functional requirement is not needed for the nose of the leading penetrator stage 4. Each penetrator stage has a conical flare tail, for generating lift forces for stabilization, designated as 14, 15, and 16 for penetrator stages 4, 5 and 6 respectively. The conical flare tails 14, 15, and 16 are shown with flare angles of $\beta_1$,$\beta_2$, and $\beta_3$. To generate axial aerodynamic forces and help induce stage separation, the flare angles of subsequent stages may be appropriately increased from the leading to the trailing penetrator stage so that $\beta_3>\beta_2>\beta_1$. Stage separation may also be helped by progressively increasing the outer diameter of the conical tails from the leading to the trailing stages so that $D_3 > D_2 > D_1$. Consequently, intermediate stage 5 will have a diameter that is $\Delta_1 D$ larger than leading stage 4, and stage 6 will have a diameter that is $\Delta_2 D$ larger than intermediate stage 5 as shown in FIG. 2. FIG. 3 shows a sectional view taken substantially as indicated along line A—A of the one half sectional view of FIG. 2 which more clearly shows the difference in diameters of stages 5 and 6. This increased frontal area will help induce more drag forces on each trailing stage causing a desired tendency for separation during flight. However, this feature may not be needed if different separation mechanisms are selected. For example, time delay fuzes could be used. If more lifting forces are needed to stablize the projectile in flight, they can be produced through the use of boattails 17, 18, and 19 with angles $\delta_1$, $\delta_2$, and $\delta_3$ as shown on penetrator stages 4, 5, and 6.

For tube launching from a smooth bore the projectile arrangement requires a rotating band (or slip ring for rifled tubes) for each stage. These bands are designated as 20, 21, and 22 for penetrator stages 4, 5, and 6 respectively. Because each flare diameter $D_1$, $D_2$, and $D_3$ progressively increases, the required heights of these bands progressively decrease from the leading to the trailing penetrator stage. The last band 22 may also be required to be an obturator (gas sealer).

Figure 4:
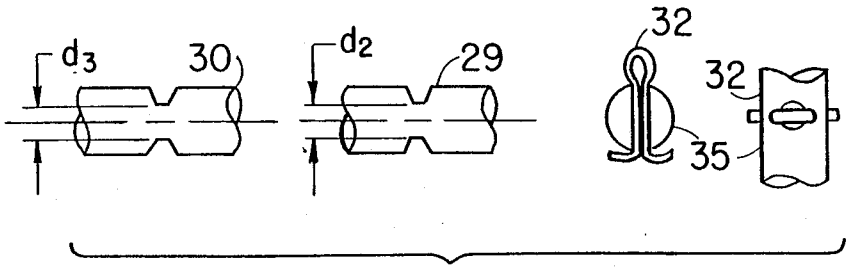
FIG. 4 shows enlargements of various elements of FIG. 2.

FIG. 2 shows the details of how rod 7 is assembled in relation to the penetrator stages of FIG. 1. The rod 7 has a head 26 and is secured by a closed cap nut 27 at its threaded end. The closed cap nut 27 is used to avoid the pushing of the rods by the hot gases produced by the propelling charges. The head 26 of rod 7 is covered by a putty 28 to create a smooth outer body and reduce frontal air drag forces. The rod 7 will have the proper number of separation notches (only two are shown in the disclosed configuration) 29 and 30 depending on the number of stages present. FIG. 4 shows a more detailed drawing of the rod diameters $d_2$ and $d_3$ at separation notches 29 and 30 respectively. These notched diameters are dimensioned and designed such that they break in the proper sequence for rearward to forward penetrator separation. In other words, $d_3$ should be smaller than $d_2$ so that $d_3$ breaks first allowing the trailing penetrator stage 6 to separate from the assembly. Obviously the design is dependent on the various loads present, strength of materials and other considerations. Stopping pins 31, 32, and 33 are inserted in holes 34, 35, and 36 to help avoid the sliding of rod 7 and to facilitate the proper separation sequence at the separation notches 29 and 30. Other rods used to interconnect the penetrator stages would also be assembled in the same way as rod 7.

This multistage penetrator projectile works by having the individual penetrator stages separate from one another in a predescribed rearward to forward sequence along a segment of the projectile's flight path. At a predetermined distance after leaving the gun tube 1, the aerodynamic forces on the projectile are such that they induce enough tensile stress in rod 7 to cause it to break at its weakest point 30. The trailing penetrator stage 6 will then separate and fly independently behind the main assembly. Then the aerodynamic forces on the intermediate stage 5 are such that they cause the breaking of rod 7 at point 29. The intermediate stage 5 will then fly independently and follow the leading penetrator stage 4. The leading penetrator stage 4 will now fly independently with the trailing stages 5 and 6 following closely behind towards the targeted impact point. The multiple impacts will result in greater lethality than a single kinetic energy penetrator with the same energy.

Instead of relying on aerodynamic forces acting upon the tails and frontal surfaces of the penetrators to induce separation of the penetrator stages other means may be employed. For example, time delay fuzes can be used with small explosive charges to separate the penetrator stages. Alternatively, a purely mechanical mechanism can be employed. The particular means for separating the penetrator stages is not limited to those described. A variety of separation methods may be employed to accomplish the desired objective of controlled separation in a rearward to forward sequence.

Obviously, numerous modifications and variations of the present invention are possible in light of the above teachings. It is therefore to be understood that within the scope of the appended claims, the invention may be practiced otherwise than as specifically described herein.

What is claimed is:

1. A multistage kinetic energy projectile comprising:

a primer case having forward and rearward ends;

a plurality of sequentially separable kinetic energy penetrators longitudinally stacked one onto the other, said plurality of penetrators having a forward leading penetrator and a rearward trailing penetrator secured to the forward end of said primer case;

means for fixidly interconnecting said plurality of kinetic energy penetrators; and means for separating said plurality of kinetic energy penetrators from one another in sequence along a segment of said multistage kinetic energy projectile's flight path so that said plurality of penetrators fly independently and in spaced relation to one another along the flight path before impact with a target, whereby upon the leading penetrator reaching the target the trailing penetrators will follow onto the target in succession.

2. The multistage kinetic energy projectile of claim 1 wherein said separating means comprises:

a plurality of time delay fuzes.

3. The multistage kinetic energy projectile of claim 1 wherein said separating means comprises:

a plurality of explosive charges.

4. The multistage kinetic energy projectile of claim 1 wherein said interconnecting means comprises:

a plurality of connecting rods.

5. A multistage kinetic energy projectile comprising:

a primer case having forward and rearward ends;

a plurality of sequentially separable kinetic energy penetrators longitudinally stacked one onto the other beginning with a forward leading penetrator and ending with a rearward trailing penetrator that is secured to the forward end of said primer case, said plurality of penetrators each having a substantially hemispherical nose and a centrally aligned rearwardly open cavity wherein the nose of each trailing penetrator fits securely into the cavity of each leading penetrator;

a plurality of rods interconnecting said plurality of penetrators by passing through the longitudinal length of said penetrators and in spaced relation with one another, said plurality of rods each having a plurality of notches placed along each rod at positions between each penetrator; and means for separating said plurality of kinetic energy penetrators from one another in a rearward to forward sequence along a segment of said multistage kinetic energy projectile's flight path so that said plurality of penetrators fly independently and in spaced relation to one another along the flight path before impact with a target.

6. The multistage kinetic energy projectile of claim 5 wherein said separating means comprises:

a plurality of time delay fuzes.

7. The multistage kinetic energy projectile of claim 5 wherein said separating means comprises:

a plurality of explosive charges.

8. A multistage kinetic energy projectile comprising:

a primer case having forward and rearward ends;

a plurality of sequentially separable kinetic energy penetrators longitudinally stacked one onto the other beginning with a forward leading penetrator and ending with a rearward trailing penetrator that is secured to the forward end of said primer case, said plurality of penetrators each having a nose and a substantially conical flare tail with a centrally aligned rearwardly open cavity wherein the nose of each trailing penetrator fits securely into the cavity of each leading penetrator, the flare tails of said plurality of penetrators having progressively increasing diameters and flare angles in a forward to rearward sequence; and a plurality of rods longitudinally passing through and interconnecting said plurality of penetrators, said plurality of rods each having a plurality of notches placed along each rod at positions between each penetrator and appropriately sized so that aerodynamic forces acting upon the flare tails of said plurality of penetrators will sever each rod at the notches in a rearward to forward sequence.

* * * * *